United States Patent [19]

Horgen

[11] Patent Number: 4,566,696

[45] Date of Patent: Jan. 28, 1986

[54] GOLF CLUB SWING TRAINING METHOD

[76] Inventor: Floyd D. Horgen, 1046 Fairlawn Dr., Rockledge, Fla. 32955

[21] Appl. No.: 518,625

[22] Filed: Jul. 29, 1983

[51] Int. Cl.[4] ..... A63B 69/36

[52] U.S. Cl. ..... 273/193 A; 273/195 A; 434/252

[58] Field of Search ..... 273/183 A, 195 A, 195 R, 273/193 R, 193 A, 194 B, 194 R, 194 A, 32 R, 35 R; 434/252

[56] References Cited

U.S. PATENT DOCUMENTS 4,432,552 2/1984 Saverino ..... 273/183 A

*Primary Examiner*—George J. Marlo

*Attorney, Agent, or Firm*—Kinney & Lange

[57] ABSTRACT

The device comprises an adjustable, raised platform including synthetic grass covering thereon and a golf club having a shortened shaft which may be weighted by lead pellets disposed in the interior of the shaft. The method includes the steps of hitting golf balls from the raised surface by swinging the club with only the left hand, only the right hand and with both hands.

1 Claim, 2 Drawing Figures

GOLF CLUB SWING TRAINING METHOD

BACKGROUND OF THE INVENTION

This invention relates to a device for training golfers in general, and more in particular to a device directed to the teaching of the proper forearm position and swing.

It is fundamental in the game of golf that a golfer must have the proper forearm and wrist position when the club impacts the ball. To that end, numerous devices have been proposed to aid in the attainment of such a correct position. In U.S. Pat. No. 2,891,796 (Cottrell) a golf training device is disclosed which includes a base, an upright standard on the base, and a laterally projecting arm carried by the standard about waist high on the person. Upon the forward swing, the arms, after striking the ball, must follow along the flight path of the ball for a substantial distance by reason of a guide section which presents a surface to the arms of the user, thereby preventing the user from prematurely swinging too closely around his own body. In U.S. Pat. No. 3,623,733 (Cavanaugh), an apparatus for swinging a golf club is disclosed which comprises a body cage member and a hitting track member to guide the proper hit movement during the swing and the movement of the golf club head in the proper pathway for contacting a golf ball. In U.S. Pat. No. 3,937,473 (Blasi), the mechanism for use in teaching of a proper golf swing is disclosed which includes a platform on which a golf tee and ball may be placed, and an erect rod fastened to the base, the upper end of which is mounted in a circular band of a size to fit freely about the user's waist. The inside of the band is fitted with contact switches which actuate an alarm signal when touched by the body of the user, indicating that the user's body was not in balance during the golf swing. U.S. Pat. No. 3,804,420 (Boyd), discloses a device comprising a cord reel, and a length of cord for wand storage of the cord on the reel. The cord being adjusted to a fingerless glove to be worn on the hand of the leading arm of the golfer. Finally, U.S. Pat. No. 4,061,340 discloses a golf swing aid which includes a horse shoe member attached to a belt or strap. The primary disadvantages of the devices of the prior art is that they do not address the problem encountered by the novice golfer, and even more advanced golfers, namely the development of wrist strength, and the development of feel for the correct swinging of the club. In most instances, the novice will only infrequently hit the ball correctly and therefore he cannot develop the correct "feel" for hitting the ball correctly. The primary reason for this deficiency is that all of the golf aids disclosed above utilize a normal length club which creates a large moment of inertia which must be counteracted by the wrist of the golfer during the swing.

A basic problem to the novice, however, is that of learning to allow each hand to perform its specific role in producing the proper swing. It is common for the beginner to permit the right and left hands to interfere with each other during the swing rather than to cooperate. None of the known prior art teaching devices assist in developing such cooperation.

SUMMARY OF THE INVENTION

The deficiencies of the prior art are overcome by the utilization of a golf club having a shortened shaft thereby reducing the moment of inertia which must be counteracted by the player's wrist. The ball is disposed on a raised platform which may be adjustable for the different heights of the players involved. Preferably, the platform is covered with a synthetic grass material. The reduced weight and inertia of the club permits the golfer to practice a swing with one hand at a time.

The invention also includes a method of teaching and practicing the proper swing which includes disposing of a golf ball on the raised platform and the utilization of a club with a shortened shaft to hit the ball.

BRIEF DESCRIPTION OF THE DRAWINGS

Further details are explained below with the help of the examples illustrated in the attached drawings in which.

DETAILED DESCRIPTION OF THE INVENTION

Figure 1:
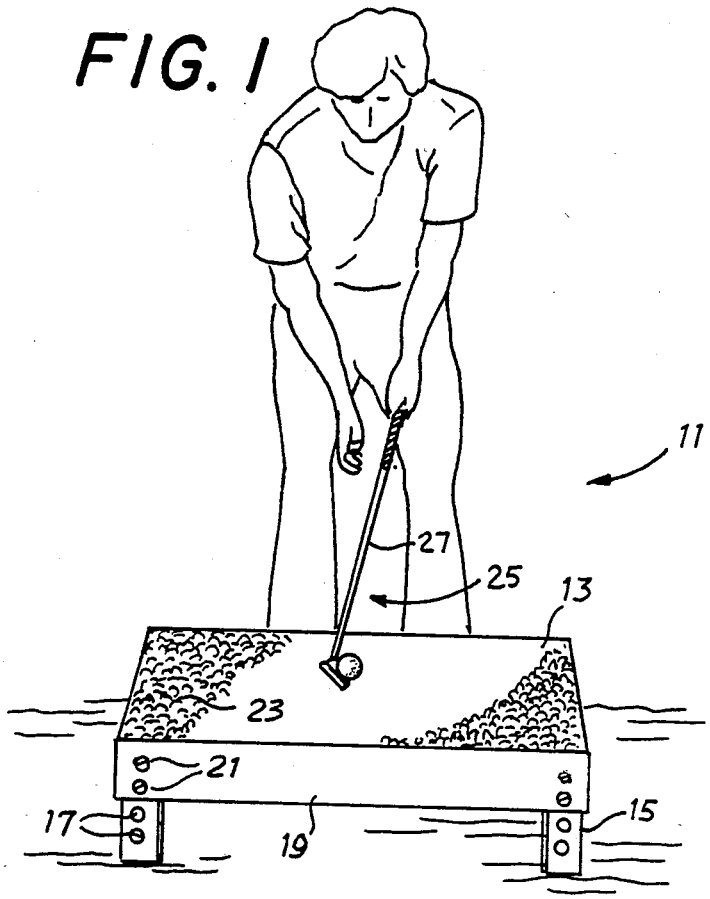
FIG. 1 is a front view of the golf training device of the present invention.

Illustrated in FIG. 1 is a golf training device 11 of the present invention. The golf training device 11 includes a platform 13 having a plurality of vertical support members 15 such as rectangular legs. The legs may include a plurality of holes 17 and may be attached to a side 19 of the platform 13 by means of screws or bolts 21. The holes 17 and the screws 21 may be used to adjust the height of the platform 13. Although the means illustrated include the holes and screws, numerous other means of adjusting the vertical position of the platform 13 can be envisaged by a person having ordinary skill in the art. For example, telescoping legs may be secured by nuts, or pins. The platform 13 is preferably covered with a mat of synthetic grass material 23.

The golf training device also includes a golf club 25 having a shaft 27 which is shortened considerably. Thus, the club 25 of the present invention is generally 27 inches long and will usually be a seven, eight or nine iron which has some substantial loft. The reason for selecting a club with considerable loft is that it is desirable to get the ball 29 airborne in order to determine how the student is progressing. Typically, the platform 13 may be varied in height depending upon the height of the player and the length of the club. The standard platform 13 would generally be 18" by 36" by 9" high and the golf club will have a 27" shaft. It is desirable to provide additional weight to the golf club so that it feels like a standard golf club or perhaps somewhat heavier. This can be done by filling the shaft with lead shot.

The principle behind the invention is that by achieving a reduction of the forces acting on the left wrist, the student can experience the feel of the correct position of the left wrist. The forces acting on the left wrist are a function of the length of the shaft because of the moment created by the head of the club. Thus, by reducing the length of the shaft, the moment produced by the head of the club is reduced and thus the strength and skill that is required to maintain the proper trajectory of the head of the club is reduced.

The invention also contemplates a method of teaching and practicing the proper golf swing. In the method of the invention a ball is placed on a horizontal platform disposed a predetermined vertical distance from the ground. A golf club having a shortened shaft is disposed in the hands of the student. The student is then instructed as to the proper stance, grip and shown the correct path of the club face. Drills are then provided to make the student understand how the path of the club face is controlled with emphasis on the correct position of the left arm and hand (assuming a right handed golfer). Advantageously, the golf club of the invention has the approximate weight of a full size club yet lacks the normal inertia permitting the student to concentrate on the feel and control of the swing.

Figure 2:
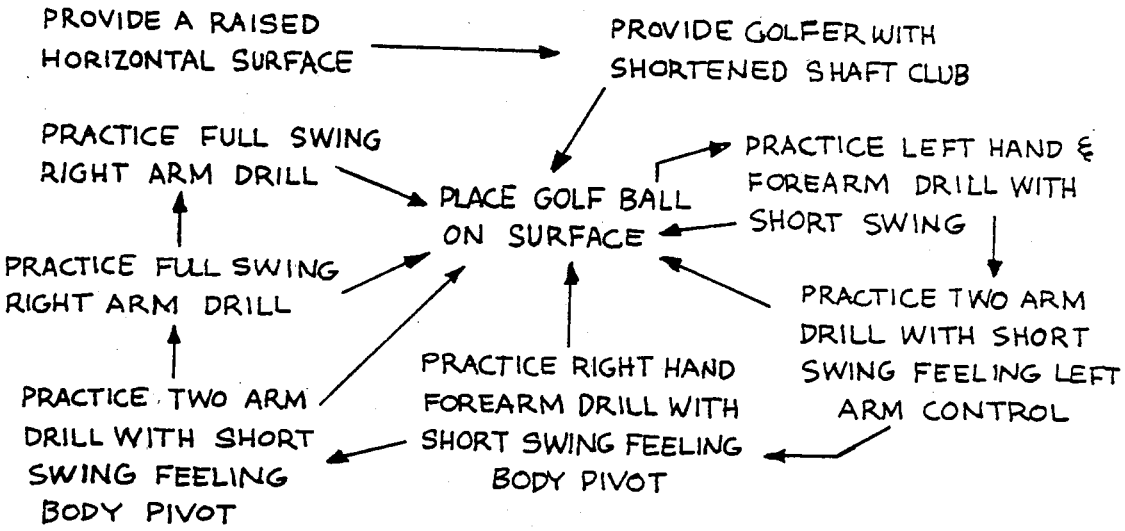
FIG. 2 is a flow diagram of the method of the invention.

Typically, the following drills are followed using the shortened shaft club as shown in the flow diagram of FIG. 2:

1. Short swing of the shortened shaft golf club with the left hand and forearm while feeling a straight to slightly convex position of the back of the left wrist;
2. Short swing of the shortened shaft golf club with both arms while experiencing the feel of the controlling left hand and forearm from drill 1;
3. Short swing of the shortened shaft golf club with the right hand and forearm while feeling the natural pivoting action of the body on the right leg and hip in the backswing and downswing and the left leg and hip in the follow through;
4. Short swing of the shortened shaft golf club with both arms while experiencing the feel of the natural pivoting action of the body on the right leg and hip in the backswing and downswing and the left leg and hip in the follow through;
5. Full swing of the shortened shaft golf club with the right arm feeling the natural pivoting of the body on the right leg and hip in the backswing and downswing and the left leg and hip in the follow through; and
6. Full swing with both arms while experiencing the feel of the natural pivoting of the body on the right leg and hip in the backswing and downswing and the left leg and hip in the follow through.

It has been found that a basic problem in learning the necessary muscle control and developing the proper muscle memory is that the left and right arms often tend to work against each other. The correct swing can only occur when each hand and arm independently follows the right path and cooperate. The present teaching and practice method of the invention, by virtue of the above listed drills, permits learning of the movements of each arm and hand with the easily managed shortened club. The actual hitting of the ball from the raised platform provides the necessary feedback so that the golfer may determine when he achieves the correct movements.

Thus, the apparatus and method of the invention permits an instructor to easily teach a person a correct golf swing by permitting the swing to be broken into its basic elements, the feel of each element by each hand and arm learned and those elements integrated into a full swing without the distortion caused by any slight deviations magnified by the inertial effect of a full length club. When the student has mastered the "feel" evidenced by the proper flight of the ball, he may then move to the full size club and be able to sense inaccuracies in his swing.

I claim:

1. A method of practicing a golf swing using a shortened shaft golf club and a raised generally horizontal surface capable of supporting a golf ball, the method comprising:

(a) hitting a ball off of the raised surface using a shortened swing of the golf club while gripping the golf club with a left hand only to experience during the shortened swing a feeling of a straight to slightly convex position of the back of the left wrist;

(b) hitting a ball off of the raised horizontal surface using a shortened swing of the golf club while gripping the golf club with both hands to repeat the feeling experienced in step (a);

(c) hitting a ball off of the raised horizontal surface using a shortened swing of the golf club while gripping the club with the right hand only to experience during the swing a feeling of a natural pivoting action of the body on the right leg and hip during back swing and down swing portions of the shortened swing and experiencing the natural pivoting action of the body on the left leg and hit during a follow-through portion of the shortened swing;

(d) hitting a ball off of the raised horizontal surface using a shortened swing of the golf club while gripping the club with both hands to repeat the feeling experienced during step (c);

(e) hitting a ball off of the raised horizontal surface using a full swing of the golf club while gripping the club with the right hand only to repeat the feeling experienced during steps (c) and (d); and (f) hitting a ball off of the raised horizontal surface using a full swing of the golf club while gripping the club with both hands to repeat the feeling experienced during steps (c), (d) and (e).

* * * * *